US009759070B2

(12) United States Patent
Zhang et al.

(10) Patent No.: US 9,759,070 B2
(45) Date of Patent: Sep. 12, 2017

(54) TURBINE BUCKET TIP SHROUD

(71) Applicant: General Electric Company, Schenectady, NY (US)

(72) Inventors: Xiuzhang James Zhang, Simpsonville, SC (US); Melbourne James Myers, Duncan, SC (US); Robert Joseph Testa, Jr., Greenville, SC (US); Haiping Wang, Greenville, SC (US)

(73) Assignee: General Electric Company, Schenectady, NY (US)

( * ) Notice: Subject to any disclaimer, the term of this patent is extended or adjusted under 35 U.S.C. 154(b) by 581 days.

(21) Appl. No.: 14/011,784

(22) Filed: Aug. 28, 2013

(65) Prior Publication Data

US 2015/0064010 A1 Mar. 5, 2015

(51) Int. Cl.
*F01D 5/18* (2006.01)
*F01D 5/22* (2006.01)

(52) U.S. Cl.
CPC ..... *F01D 5/187* (2013.01); *F01D 5/186* (2013.01); *F01D 5/225* (2013.01); *F05D 2240/307* (2013.01); *F05D 2240/81* (2013.01); *F05D 2260/20* (2013.01); *F05D 2260/201* (2013.01); *F05D 2260/202* (2013.01)

(58) Field of Classification Search
CPC ..... F01D 5/187; F01D 5/188; F05D 2240/81; F05D 2240/307; F05D 2260/20; F05D 2260/201; F05D 2260/202
See application file for complete search history.

(56) References Cited

U.S. PATENT DOCUMENTS 3,816,022 A * 6/1974 Day ..... F01D 5/185 416/191
4,130,373 A * 12/1978 Giles ..... F01D 5/185 415/1
4,259,037 A * 3/1981 Anderson ..... F01D 5/185 416/92
5,460,486 A * 10/1995 Evans ..... F01D 5/187 415/115
5,889,254 A * 3/1999 Jones ..... B23K 26/34 148/512
6,152,695 A * 11/2000 Fukue ..... F01D 5/187 415/115
6,340,284 B1 * 1/2002 Beeck ..... F01D 5/187 415/115
6,471,480 B1 10/2002 Balkcum, III et al.
6,811,378 B2 * 11/2004 Kraft ..... F01D 5/18 416/191
6,997,679 B2 * 2/2006 Beddard ..... F01D 5/187 415/115
7,273,347 B2 * 9/2007 Rathmann ..... F01D 5/186 415/173.6

(Continued)

FOREIGN PATENT DOCUMENTS

JP 58047104 A * 3/1983

*Primary Examiner* — Phutthiwat Wongwian
*Assistant Examiner* — Jessica Kebea
(74) *Attorney, Agent, or Firm* — Eversheds Sutherland (US) LLP

(57) ABSTRACT

The present application provides a turbine bucket. The turbine bucket may include an airfoil and a tip shroud attached to the airfoil. The tip shroud may include a cooling core and an enhanced cooling surface.

6 Claims, 9 Drawing Sheets

(56) References Cited

U.S. PATENT DOCUMENTS

| | | | | |
|---|---|---|---|---|
| 7,520,715 | B2 * | 4/2009 | Durocher | F01D 9/04 415/116 |
| 7,568,882 | B2 | 8/2009 | Brittingham et al. | |
| 7,648,333 | B2 * | 1/2010 | Tibbott | F01D 5/081 415/115 |
| 7,946,816 | B2 | 5/2011 | Brittingham | |
| 7,946,817 | B2 | 5/2011 | Brittingham | |
| 7,976,280 | B2 | 7/2011 | Brittingham et al. | |
| 8,096,767 | B1 | 1/2012 | Lian | |
| 8,313,301 | B2 | 11/2012 | Hudson | |
| 8,322,986 | B2 * | 12/2012 | DeSander | F01D 5/187 416/96 R |
| 2001/0048878 | A1 | 12/2001 | Willett et al. | |
| 2005/0084372 | A1 | 4/2005 | Zhang et al. | |
| 2005/0220618 | A1 | 10/2005 | Zhang et al. | |
| 2009/0180894 | A1 * | 7/2009 | Brittingham | F01D 5/225 416/97 R |
| 2009/0304520 | A1 | 12/2009 | Brittingham et al. | |
| 2012/0070309 | A1 * | 3/2012 | Zambetti | F01D 5/225 416/97 R |
| 2012/0114480 | A1 | 5/2012 | Amaral et al. | |

* cited by examiner

TURBINE BUCKET TIP SHROUD

TECHNICAL FIELD

The present application and the resultant patent relate generally to gas turbine engines and more particularly relate to a turbine bucket tip shroud with a cooling core and an optimized cooling surface for improved cooling that may be insensitive to bucket segment gaps and the like.

BACKGROUND OF THE INVENTION

Generally described, a gas turbine bucket often includes an elongated airfoil with an integrated tip shroud attached thereto. The tip shroud attaches to the outer edge of the airfoil and provides a surface that runs substantially perpendicular to the airfoil surface. The surface area of the tip shroud helps to hold the turbine exhaust gases onto the airfoil such that a greater percentage of the energy from the turbine exhaust gases may be converted into mechanical energy. This increased percentage generally leads to an increase in overall turbine efficiency and performance. The tip shroud also may provide aeromechanical damping and shingling (fretting) prevention to the airfoil. Many different types of turbine bucket, airfoil, and tip shroud configurations may be used.

The connection between the tip shroud and the airfoil may become highly stressed during operation because of the mechanical forces applied via the rotational speed of the turbine. When these mechanical stresses are coupled with the thermal stresses and high metal temperatures associated with the harsh operational environment of the turbine, overall performance may be compromised over the useful lifetime of the airfoil. Reducing the metal temperatures experienced by the tip shroud by cooling it during operation could extend the useful lifetime of the component. The use of such cooling flows, however, may reduce overall efficiency. Moreover, the cooling flows may be reduced or ineffective because of the segment gaps between adjacent bucket tip shrouds.

There is thus a desire for an improved turbine bucket tip shroud. Such an improved turbine bucket tip shroud may provide optimized cooling so as to reduce the sensitivity to bucket segment gaps while increasing the overall lifetime of the component for improved reliability and availability.

SUMMARY OF THE INVENTION

The present application and the resultant patent thus provide a turbine bucket. The turbine bucket may include an airfoil and a tip shroud attached to the airfoil. The tip shroud may include a cooling core and an enhanced cooling surface. The enhanced cooling surface may include an upwardly or downwardly radiused exit and/or a radiused end.

The present application and the resultant patent further may provide a turbine. The turbine may include a first bucket with a first tip shroud and an enhanced cooling surface and a second bucket with a second tip shroud. The second tip shroud may be adjacent to the enhanced cooling surface of the first tip shroud for improved cooling.

The present application and the resultant patent further may provide a tip shroud for use with a turbine bucket. The turbine shroud may include a cooling core and an abutment surface. The abutment surface may include an enhanced cooling surface. The enhanced cooling surface may include a radiused exit and/or a radiused end. Any number of tip shrouds may be used.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
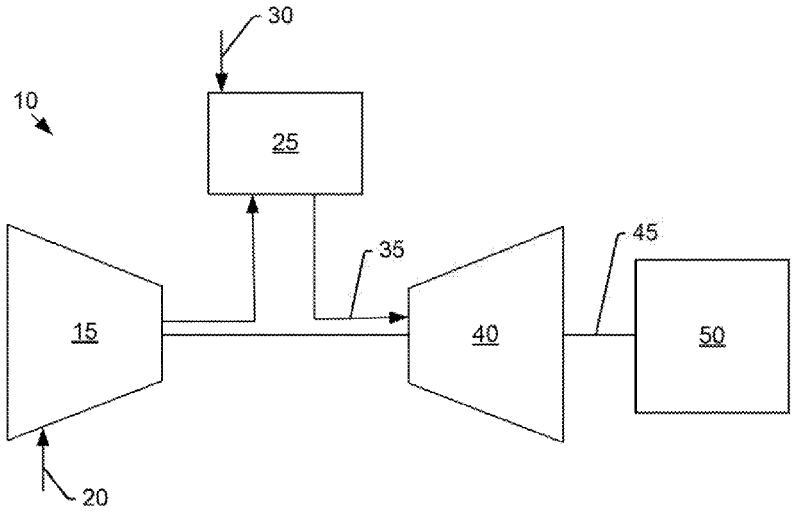
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, liquid fuels, various types of syngas, and/or other types and combinations of fuels. The gas turbine engine 10 may be any one of a number of different gas turbine engines offered by General Electric Company of Schenectady, New York, including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
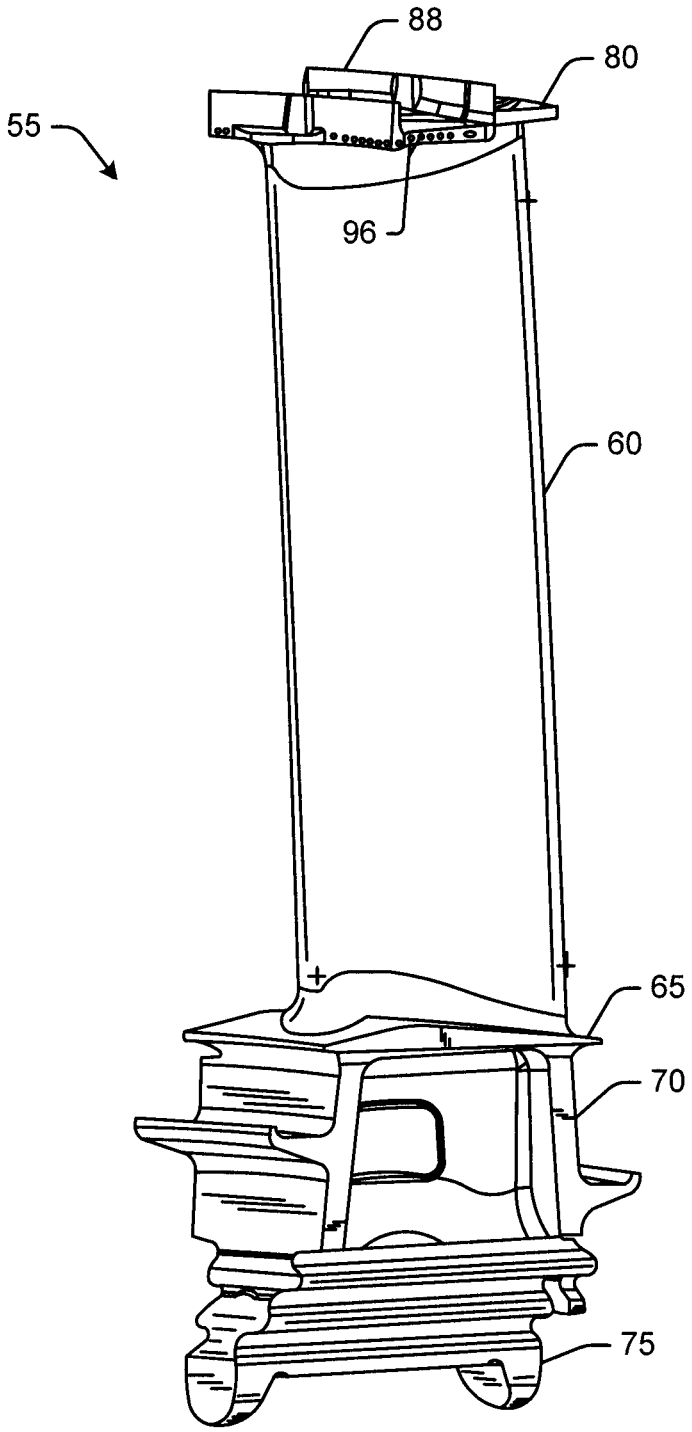
FIG. 2 is a perspective view of a turbine bucket having a tip shroud thereon.

FIG. 2 shows an example of a turbine bucket 55 that may be used with the turbine 40. The turbine 40 may include any number of the buckets 55 circumferentially positioned about a rotor. As described above, each turbine bucket 55 may include an airfoil 60. The airfoil 60 is the active component that intercepts the flow of hot combustion gases 35 to convert the energy of the combustion gases 35 into tangential motion. Each bucket 55 also may include a platform 65, a shank 70, and a dovetail 75 at a lower end thereof for attaching to the rotor. Other components and other configurations may be used herein.

Figure 3:
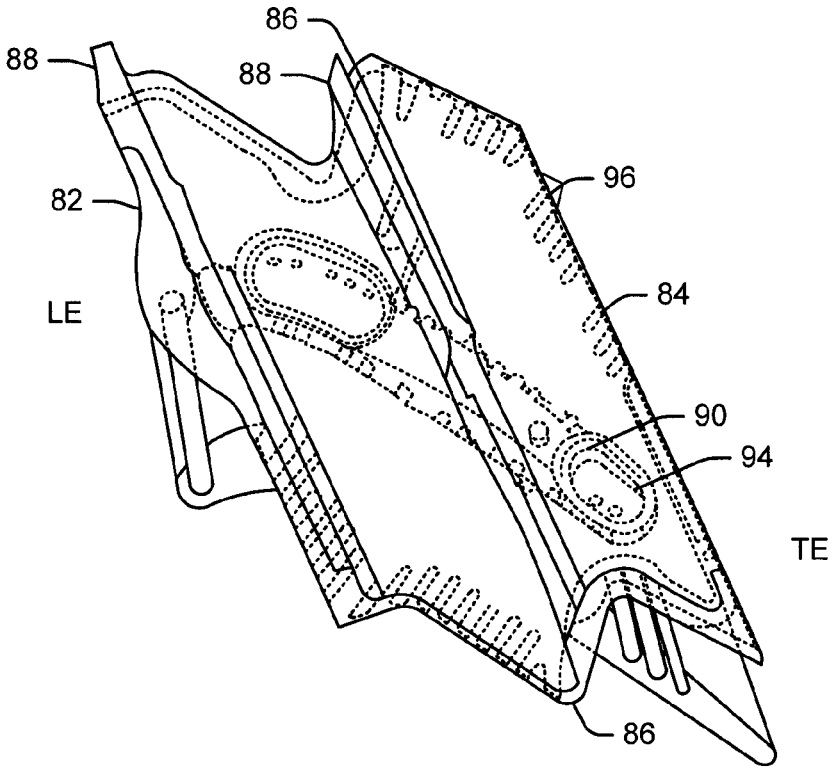
FIG. 3 is a top sectional view of the tip shroud of FIG. 2 showing a core with exit slots.
Figure 4:
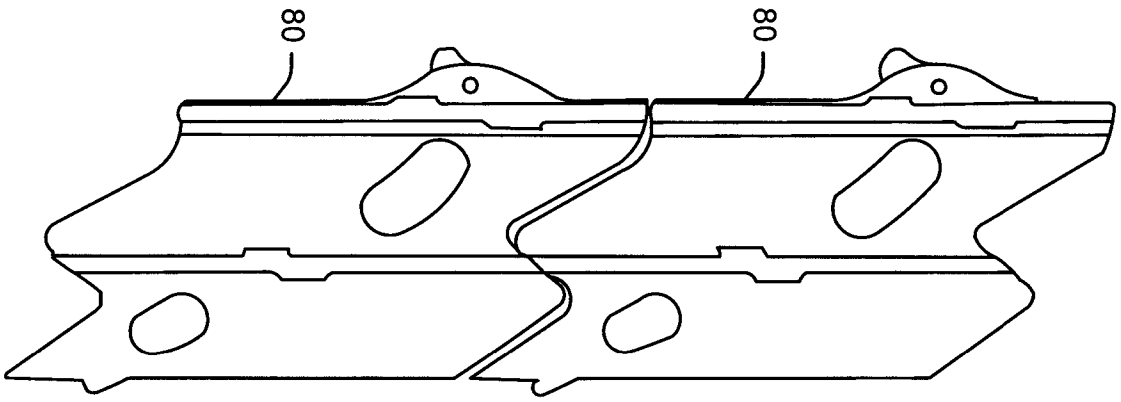
FIG. 4 is a top plan view of a pair of adjacent turbine buckets with tip shrouds.

A tip shroud 80 may extend over the end of the airfoil 60. As is shown in FIG. 3, the tip shroud 80 may extend from a leading edge 82 to a trailing edge 84 and may have a pair of Z-notches 86 therebetween. The tip shroud 80 also may have one or more seal rails 88 may be positioned on the tip shroud 80. The seal rails 88 prevent or limit the passage of combustion gases 35 through the gap between the tip shroud 80 and the inner surface of the surrounding components. As is shown in FIG. 4, each tip shroud 80 may engage at circumferentially opposed ends with adjacent tip shrouds to form a generally annular ring or shroud circumscribing the hot gas path.

Figure 5:
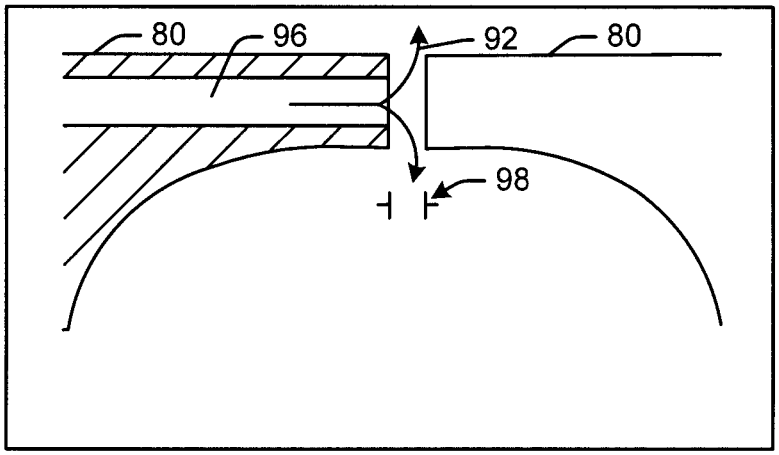
Prior Art FIG. 5
FIG. 5 is a schematic view of the intersection of the pair of turbine buckets with tip shrouds thereon.

Referring again to FIG. 3, some or all of the tip shrouds 80 may include a cooling core 90 therein. The cooling core 90 may be in communication with a flow of cooling air 92. The cooling air 92 may be a flow of air 20 from the compressor 15 or elsewhere. The cooling core 90 may be in communication with one or more air plenums 94 extending through the airfoil 60. The cooling core 90 may have a number of exit slots 96 extending towards the leading edge 82, the trailing edge 84, and/or the Z-notches 86. Conventionally, as is shown in FIG. 5, an exit slot 96 of a first tip shroud 80 may flow the cooling air 92 towards an adjacent tip shroud. The cooling flow 92, however, may be reduced or may be ineffective because of a bucket segment gap 98 therebetween. Other components and other configurations may be used herein.

Figure 6:
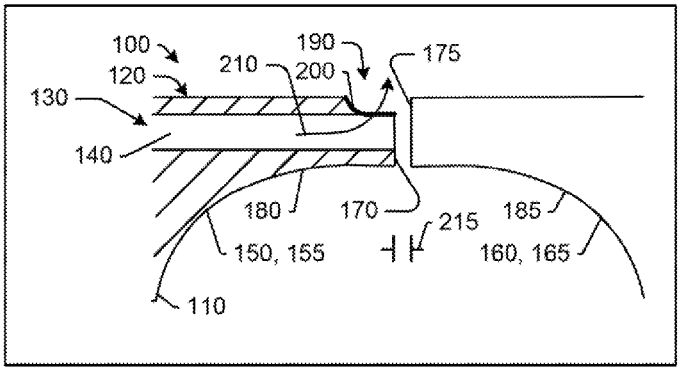
FIG. 6 is a schematic view of a pair of turbine bucket tip shrouds as may be described herein.

FIG. 6 shows a portion of a turbine bucket 100 as may be described herein. In a manner similar to that described above, each turbine bucket 100 may include an airfoil 110 with a tip shroud 120 thereon. Each tip shroud 120 may include a cooling core 130 with a number of exit slots 140. The exit slots 140 of a first tip shroud 150 of a first bucket 155 may face a second tip shroud 160 of a second bucket 165 so as to provide cooling thereto.

Specifically, a number of the exit slots 140 in the first turbine shroud 150 may extend to a first abutment surface 170 about a trailing edge 180 thereof The tip shroud 150 of the first bucket 155 may face a second abutment surface 175 of the second tip shroud 160 along a leading edge 185 of the second bucket 165. The exit slots 140 may be in the form of an enhanced cooling surface 190. Specifically, the enhanced cooling surface 190 may have an upwardly radiused exit 200. The size, shape, and configuration of the upwardly radiused exit 200 may vary. The upwardly radiused exit 200 may optimize the direction of a cooling flow 210 towards the abutment surface 175 of the second tip shroud 160 for improved cooling. The optimized cooling flow 210 may permit the use of a smaller segment gap 215 therebetween. Other types of enhanced cooling surfaces 190 may be used. Other components and other configurations also may be used herein.

Figure 7:
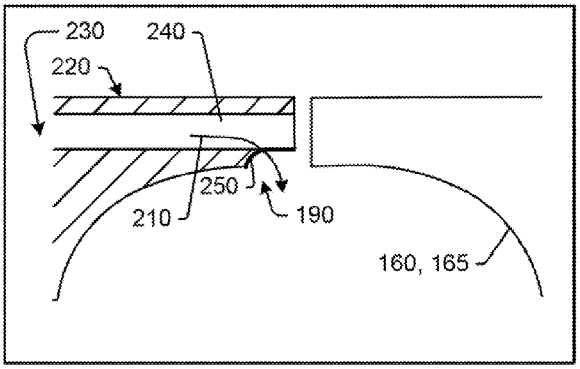
FIG. 7 is a schematic view of an alternative embodiment of a pair of turbine bucket tip shrouds as may be described herein.

Similarly, FIG. 7 shows an alternative embodiment of a tip shroud 220. The tip shroud 220 may have a cooling core 230 with a number of exit slots 240. The exit slots 240 also may be a type of an enhanced cooling surface 190. In this example, the enhanced cooling surface 190 may have a downwardly radiused exit 250. The size, shape, and configuration of the downwardly radiused exit 250 may vary. The downwardly radiused exit 250 may direct the cooling flow 210 towards the hot gas path so as to optimize the direction of the cooling flow 210 towards the abutment surface 175 of the second tip shroud 160 for improved cooling. Other types of enhanced cooling surfaces 190 may be used. Other components and other configurations may be used herein.

Figure 8:
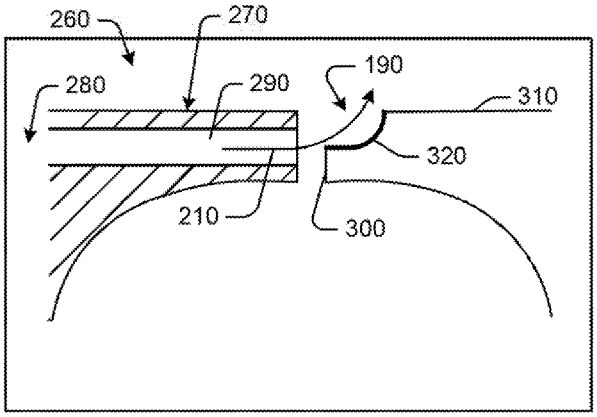
FIG. 8 is a schematic view of an alternative embodiment of a pair of turbine bucket tip shrouds as may be described herein.
Figure 9:
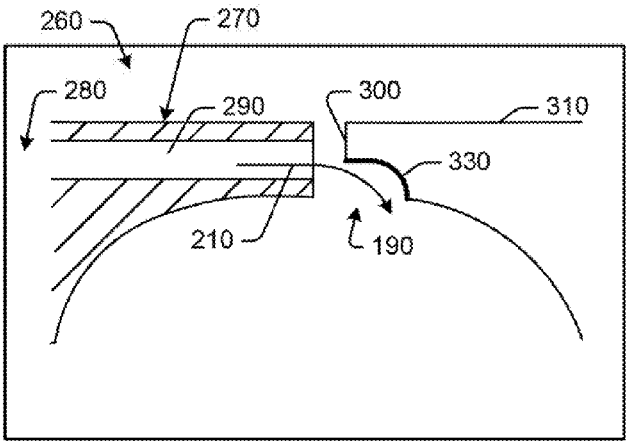
FIG. 9 is a schematic view of an alternative embodiment of a pair of turbine bucket tip shrouds as may be described herein.

FIG. 8 shows a further embodiment of a pair of tip shrouds 260. In this example, a first tip shroud 270 may have a cooling core 280 with a number of exit slots 290 therein. The exit slots 290 of the first tip shroud 270 may face an abutment surface 300 of a second tip shroud 310. The abutment surface 300 also may be a type of an enhanced cooling surface 190. In this example, the enhanced cooling surface 190 may have an upwardly radiused end 320. The size, shape, and configuration of the upwardly radiused end 320 may vary. Likewise in the example of FIG. 9, the enhanced cooling surface 190 may be in the form of a downwardly radius end 330. The size, shape, and configuration of the downwardly radiused end 330 may vary. Other types of enhanced cooling surfaces 190 may be used. Other components and other configurations also may be used herein.

In use, the enhanced cooling surfaces 190 in the form of the radiused exits 200, 250, the radiused ends 320, 330, and the like may provide an optimized flow of air 210 from the first tip shroud 150 to the second tip shroud 160 so as to reduce the bucket segment gap 215 therebetween. This direction thus optimizes the cooling flow 210 for robust cooling that may be insensitive to the nature of the bucket segment gaps 215 therebetween. Such robust cooling may provide longer bucket service life without a risk of overheating. Such improvements thus may provide increased component reliability and availability.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A turbine bucket, comprising:
an airfoil; and
a tip shroud attached to the airfoil;
the tip shroud comprising:
a cooling core, a leading edge, and a trailing edge comprising a surface;
a plurality of exit slots extending from the cooling core to the surface of the trailing edge; and
an enhanced cooling surface comprising a concave exit intersecting the surface of the trailing edge and a radially inward bottom surface of the tip shroud,
wherein the leading edge comprises a radiused end,
wherein the radiused end comprises a concave recess intersecting the leading edge and a radially outward top surface of the tip shroud.

2. The turbine bucket of claim 1, wherein the concave exit comprises a radiused exit.

3. The turbine bucket of claim 1, wherein the plurality of exit slots also extend to a leading edge or a Z-notch.

4. The turbine bucket of claim 1, wherein the plurality of exit slots comprise a flow of cooling air therethrough.

5. The turbine bucket of claim 1, wherein the tip shroud comprises a sealing rail thereon.

6. A turbine bucket, comprising:
an airfoil; and
a tip shroud attached to the airfoil; the tip shroud comprising:

a cooling core, a leading edge, and a trailing edge comprising a surface;

a plurality of exit slots extending from the cooling core to the surface of the trailing edge; and an enhanced cooling surface comprising a concave exit intersecting the surface of the trailing edge and a radially inward bottom surface of the tip shroud, wherein the leading edge comprises a radiused end, wherein the radiused end comprises a concave recess intersecting the leading edge and the radially inward bottom surface of the tip shroud.

* * * * *